United States Patent [19]

Masheder

[11] 4,327,659

[45] May 4, 1982

[54] MINIMUM DRAG FLUID REACTION ELEMENT AND FLUID CONTROL METHODS

[75] Inventor: Henry Masheder, London, England

[73] Assignee: Masheder Design Studies Ltd., London, England

[21] Appl. No.: 962,810

[22] Filed: Nov. 22, 1978

[30] Foreign Application Priority Data

Nov. 29, 1977 [GB] United Kingdom ..... 49576/77

[51] Int. Cl.[3] ..... B63H 25/06

[52] U.S. Cl. ..... 114/162; 114/128; 114/140; 114/283

[58] Field of Search ..... 114/127, 128, 132, 135, 114/136, 140, 141, 144 R, 145 R, 145 A, 162, 164, 170, 271, 283; 440/13, 14, 15, 82

[56] References Cited

U.S. PATENT DOCUMENTS

| | | | |
|---|---|---|---|
| 231,595 | 8/1880 | Mareglia | 114/164 X |
| 433,955 | 8/1890 | McPartland | 114/128 X |
| 1,600,419 | 9/1926 | Mainelli | 114/162 |
| 1,777,912 | 10/1930 | Corcoran | 114/162 |
| 3,776,171 | 12/1973 | Sibthorpe | 114/136 X |
| 3,946,693 | 3/1976 | Brown | 114/128 X |

FOREIGN PATENT DOCUMENTS

| | | | |
|---|---|---|---|
| 301580 | 5/1916 | Fed. Rep. of Germany | 114/132 |
| 23596 | 12/1956 | Fed. Rep. of Germany | 114/137 |
| 1430517 | 3/1965 | France | 114/136 |
| 651984 | 1/1963 | Italy | 114/283 |
| 214332 | 4/1924 | United Kingdom . | |
| 245436 | 7/1926 | United Kingdom . | |
| 1039592 | 8/1966 | United Kingdom . | |
| 1134011 | 11/1968 | United Kingdom . | |
| 1201021 | 8/1970 | United Kingdom . | |
| 1212380 | 11/1970 | United Kingdom . | |
| 1483978 | 8/1977 | United Kingdom . | |

*Primary Examiner*—George E. A. Halvosa

*Attorney, Agent, or Firm*—Wender, Murase & White

[57] ABSTRACT

A minimum drag fluid reaction element including a rotatable shaft adapted to be supported by a vessel carried upon or within a fluid medium; and a rigid fluid reaction fin fixedly attached to the shaft for extension into the fluid medium, the shaft and the fin extending in opposite directions from a common intersection and forming an angle other than a right angle therebetween; the axis of rotation of the shaft lying in a plane generally normal to the fin whereby rotation of the shaft moves the fin through a path describing a right conical section. The angle between the fin and the shaft is preferably obtuse and the plane containing the axis of rotation of the shaft peripherally bisects the fin.

15 Claims, 17 Drawing Figures

MINIMUM DRAG FLUID REACTION ELEMENT AND FLUID CONTROL METHODS

BACKGROUND OF THE INVENTION

1. Field of the Invention

The present invention relates generally to control elements for vessels which are carried upon or within a fluid medium; and, more particularly, to fluid reaction elements and control methods for stabilizing or steering such vessels while exhibiting extremely low head loss.

2. Description of the Prior Art

Control elements of various designs and configurations are well known for stabilizing or otherwise controlling the movement of a vessel borne upon or within a fluid medium. These elements may take any of a number of physical forms and include rudders for various types of watercraft and aircraft, retractable keels for watercraft (e.g., centerboards), and large stabilizing fins for reducing roll and yaw of very large ships.

Over the years, considerable effort has been directed to the improvement of the aerodynamic or hydrodynamic designs of such vessels, but surprisingly little attention has been given to the fluid dynamics relating to the control or fluid reaction elements which are used. For example, the rudders and keels of boats, particularly sailboats, employ designs literally centuries old. The inherent deficiencies of such conventional control or fluid reaction elements limit, and thus at least partially diminish, many other recent improvements in the hydrodynamic design of various watercraft.

One of the significant problems with control elements such as rudders, stabilizers and similar devices is that they can impose quite a large drag force when used with permanent bias. Much design work has been done on sailing craft, for example, to try to reduce the drag by making the rudder smooth to the shaft or keel extension and by providing flexible rubber farings which bend as the rudder is disposed. Such structures are exemplified by the rudders disclosed in U.S. Pat. Nos. 594,068 and 3,670,685.

Such conventional rudders are not fully satisfactory since sliding or bending is required and in addition, only minor reductions in head loss or drag occur.

SUMMARY OF THE INVENTION

It is, therefore, an object of the present invention to construct a fluid reaction element which exhibits a minimum head loss.

The present invention has a further object in the construction of a rudder having a neutral position with minimum drag, controlling positions for effecting steering control, and a brake position for presenting maximum drag.

It is another object of the present invention to construct a fluid reaction element for stabilizing a vessel on or within a fluid medium and which may be easily moved between an operative position and an inoperative position without having to retract the element into the interior of the vessel.

In accordance with the present invention, the foregoing objects and others may be realized by providing a minimum drag fluid reaction element including a rotatable shaft for a vessel borne upon or within a fluid medium; and a rigid fluid reaction fin fixedly attached to the shaft for extension into the fluid medium, the shaft and the fin extending in opposite directions from a common intersection and forming an angle other than a right angle therebetween; the axis of rotation of the shaft lying in a plane generally normal to the fin whereby rotation of the shaft moves the fin through a path describing a right conical section. The angle between the fin and the shaft is preferably obtuse and the plane containing the axis of rotation of the shaft peripherally bisects the fin.

The present invention exhibits a number of advantages over the prior art in that is presents a minimum drag to the fluid medium by presenting an airfoil or hydrofoil profile to the flow; that the element can be effectively retracted to give minimum obstruction without withdrawal to the interior of a vessel; that the element may be made self-retracting under flow forces; that the element automatically moves to a retracted position when engaged by an obstruction in the moving path; and that the element can impose a moment appropriate to that required as the vessel or craft heels over either due to wind on the sails or centrifugal forces imposed by turning movements.

The present invention relates, generally, to minimum drag, fluid reaction or control elements for vessels carried upon or within a fluid medium. Thus, the control element of the present invention is equally adaptable, in principle, to both aircraft and watercraft regardless of whether the vessel is designed for primary operation above or within (e.g., submarine) the fluid medium. However, for ease of description, the present invention will be described with reference solely to watercraft adapted for movement upon the surface of water.

Conventional control elements for watercraft have different designs and configurations depending particularly upon the type of control under consideration. Thus, rudders employed for steering are designed with certain functional aspects materially different from those with regard to a keel member employed for lateral stability. Then, too, stabilizers employed on large ships to minimize yaw and roll are designed with yet further considerations of operative importance. On the contrary, the fluid reaction element in accordance with the present invention is equally effective for use as a rudder, a keel element, or a stabilizer; the primary consideration separating the applications being merely the size of the element necessary to achieve the desired purpose. Consequently, the control element of the present invention enjoys a wide range of applicability.

Another disadvantageous characteristic of the typical prior art control element (regardless of its particular function) is its inherent high head loss. For example, a rudder for a ship inherently presents a significant drag force, even in a neutral condition; the term "neutral condition" referring to the position where the rudder is disposed at an angle of zero degrees or parallel to the direction of travel of the vessel relative to the flow of the fluid medium. In other words, regardless of the angular relationship between the rudder and the flow of water, the rudder always projects into the fluid medium, thus giving rise to an inherent drag force whether or not the rudder is performing its purpose for steering.

Different concerns are evident with respect to keel members (particularly centerboards) and stabilizers for yaw and roll (hereinafter, collectively denoted yaw stabilizers). In connection with these elements, some mechanism typically is provided for retracting the element within the vessel when the element is not needed. The mechanism for retracting these elements is cumbersome and space consuming, while typically quite expensive as well. The control element of the present invention, however, overcomes all of the above deficiencies in a simple and unique way.

Other objects and advantages of the present invention will become apparent from the following description of the preferred embodiments when taken in conjunction with the accompanying drawings.

DESCRIPTION OF THE PREFERRED EMBODIMENTS

Figure 1:
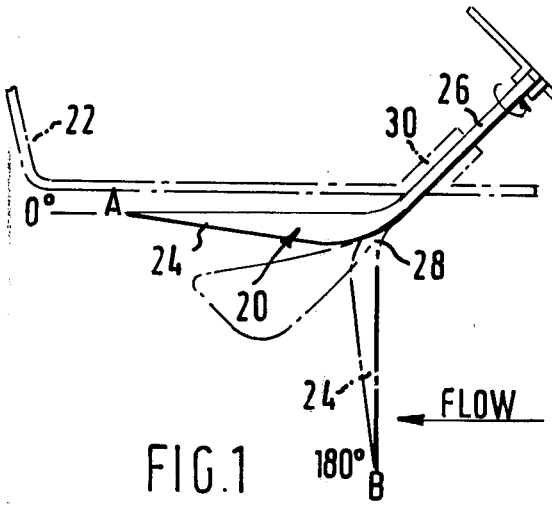
FIG. 1 is a side elevational view of a preferred embodiment of a fluid reaction element according to the present invention used as a rudder for a watercraft and illustrated in both the minimum and maximum drag configurations.
Figure 1A:
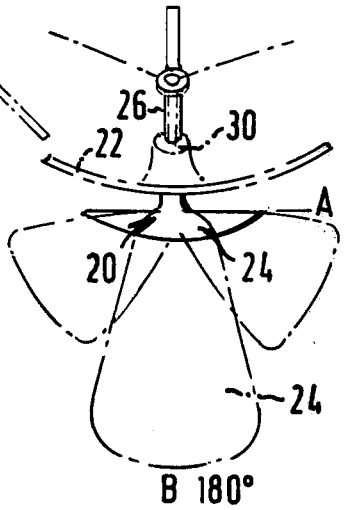
FIG. 1*a* is an end elevational view of the rudder shown in FIG. 1.

Referring to FIGS. 1 and 1*a*, a preferred embodiment of a fluid reaction or control element in accordance with the present invention is designated generally as 20 and is used for steering control of a vessel 22. The control element 20 includes a generally flat fin 24 having a major steering surface and a minor edge portion, and a support shaft 26, the two members extending in opposite directions from a common intersection 28. As will be described in greater detail below, the axis of the shaft 26 preferably forms an obtuse angle with respect to the fin 24 as can be appreciated from FIG. 1.

Shaft 26 is supported for rotation in a bearing 30 attached to the hull of vessel 22. Bearing 30 may be any suitable fluid-tight assembly for supporting the shaft 26 such that it extends from the inside of the vessel to the exterior where it joins the fluid reaction fin 24. Because of the obtuse angle between the fin 24 and shaft 26, the fin will follow a path describing a right conical section upon rotation of the shaft.

FIGS. 1 and 1*a* show the fin 24 in both a neutral or minimum drag position A and a maximum drag position B which is separated from position A by 180°. When the craft is under motion and the use of the control element is unnecessary, it will be in the minimum drag configuration lying parallel to and adjacent the hull, presenting a minimum profile to the fluid medium. As it becomes necessary to provide control for the craft, rotation of shaft member 26 in either direction will cause rotation of fin 24 through a path which describes a right conical section. Rotation of shaft 26 through 180° will cause rotation of the fin 24 from position A to position B such that a maximum profile is presented to the fluid. The fin thus can function as a brake as well as a rudder.

Usually, when the control element is employed as a rudder, only minor corrections are required, and the hydrodynamic design of fin 24 presents a minimum drag force in the direction of travel while yet providing a sufficient transverse reaction to steer the vessel. Thus, the turning operation is achieved with a minimum loss of forward velocity.

Figure 2:
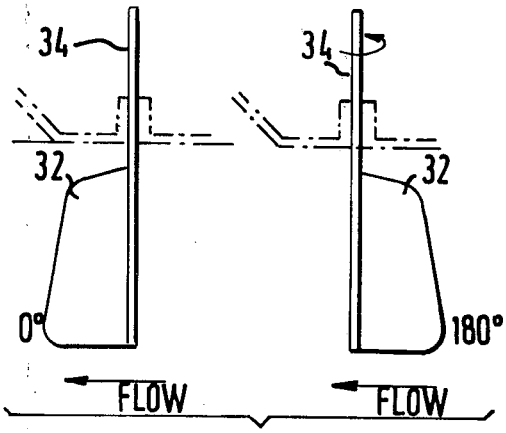
FIG.2 PRIOR ART
FIG. 2 includes two diagrammatic side elevational views of rudders in accordance with the prior art.
Figure 3:
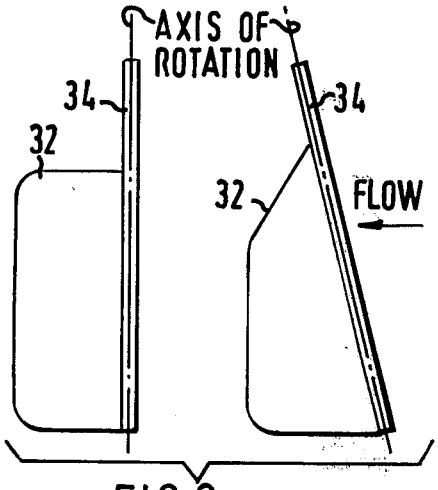
FIG.3 PRIOR ART
FIG. 3 includes two diagrammatic side elevational views, similar to FIG. 2, showing vertical and skew axes of rotation for rudders in accordance with the prior art.

The operation of the present control element is to be compared with that of prior art rudders as illustrated in FIGS. 2 and 3. First, because the conventional rudder mechanisms affix a substantially planar plate 32 to a typically cylindrical shaft 34 with the axis of the shaft lying in the plane of the plate, movement of the rudder directly follows that of the shaft. Accordingly, the motion of plate 32 may be characterized as describing a right cylindrical or circular section, as compared with the right conical section of the control element of the present invention. In addition, rotation of shaft 34 through 180° causes movement of the plate 32 through an equal angular path from a first neutral position back to a second neutral position. Thus, maximum drag on the prior art control elements will be achieved by a rotation of 90° of the control shaft, versus 180° of rotation of shaft 26 of the present control element. Even skewing the axis of rotation of a conventional rudder, as shown in FIG. 3, will not provide a different consequence.

Figure 4:
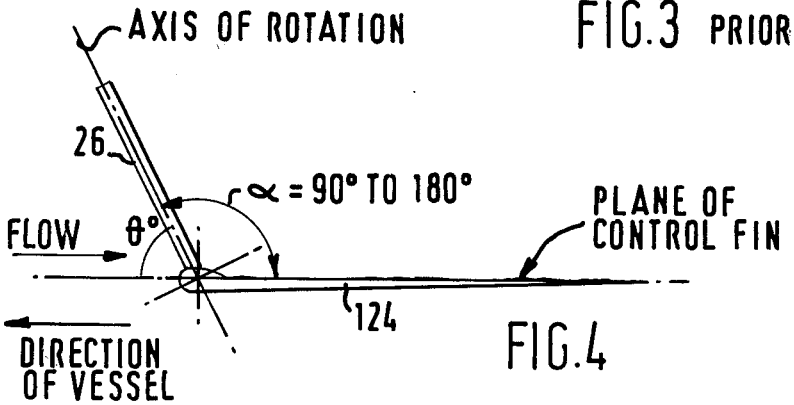
FIG. 4 is a side elevational view of a modification of the control element of FIG. 1 according to the present invention, showing the relationship between the plane of the control fin and the axis of rotation.
Figure 6:
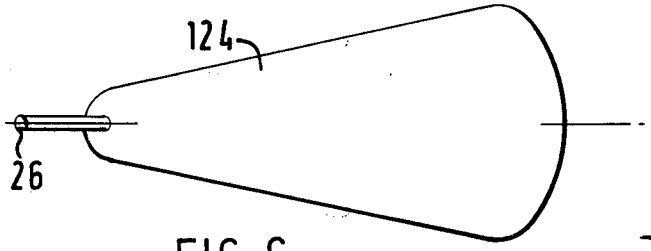
FIG. 6 is a top plan view of the control element of FIG. 4.
Figure 5:
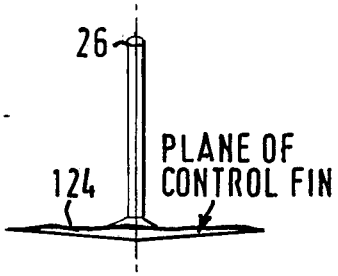
FIG. 5 is an end view of the control element of FIG. 4.

Referring to FIGS. 4–6, a modified control element according to the present invention is illustrated and includes a flat or planar fin 124 having its major steering surface fixedly attached to shaft 26. Fin 124 may have any desired shape, but preferably has a width which tapers toward the common intersection with shaft 26, as shown in FIG. 6. As mentioned above, shaft 26 preferably forms an obtuse angle $\alpha$ with respect to fin 124 with the axis of rotation of the shaft lying in a plane normal to and preferably bisecting the fin as illustrated. If the element is to be used as a rudder, the axis of shaft 26 is preferably disposed in a bearing which rotatably supports the shaft at an acute angle $\theta$ in a vertical plane including the central longitudinal axis of the vessel. So that the major steering surface of the fin 124 will lie parallel to a horizontal plane containing the central longitudinal axis of the vessel in a neutral position (position A in FIG. 1), angle $\theta$ should be equal to 180° minus angle $\alpha$, angle $\alpha$ being an obtuse angle greater than 90° and less than 180°. If $\theta$ equals 45° and $\alpha$ equals 135°, the fin will lie generally in a vertical plane normal to the central longitudinal axis of the vessel when in the brake position (position B in FIG. 1).

Figure 7:
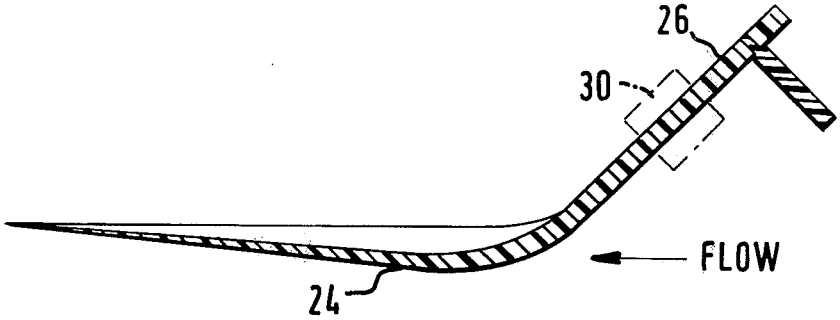
FIG. 7 is a longitudinal sectional view of the control element of FIG. 1.
Figure 8:
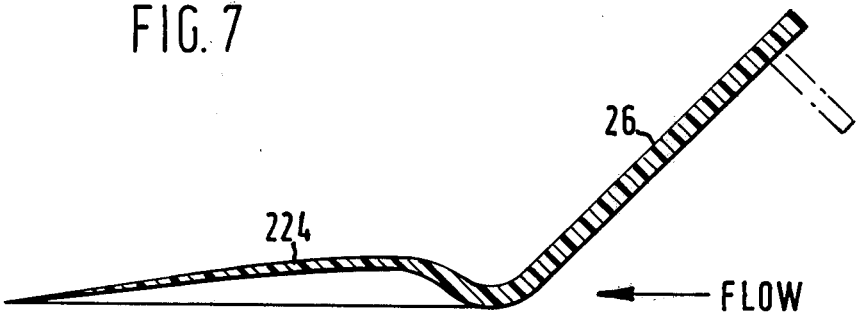
FIG. 8 is a longitudinal sectional view, similar to FIG. 7, showing another modification of the control element of the present invention.

The particular shape of fin 24 according to the present invention may be varied to exhibit additional or secondary fluid reaction forces to suit particular applications. Fin 24 shown in FIGS. 1 and 7, for example, is concavo-convex, the concave side thereof facing the obtuse arc between the fin and shaft 26. Similarly, fin 224 of FIG. 8 is concavo-convex with the convex side facing the obtuse arc, while fin 124 of FIGS. 4–6 and 9 is flat or planar.

From Bernoulli's principle, it is known that dynamic forces across a curved surface will result in a larger velocity vector across the curved surface of the foil than across a substantially linear, or planar, surface. This will give rise to a pressure gradient which, consequently, provides a force directed away from the curved surface. Thus, fin 24 in FIG. 7 will result in a downward force, while the opposite is true of fin 224 in FIG. 8, which will provide a lifting force. In certain multi-hull watercraft, and in other applications, this will provide an added measure of necessary stability.

Figure 9:
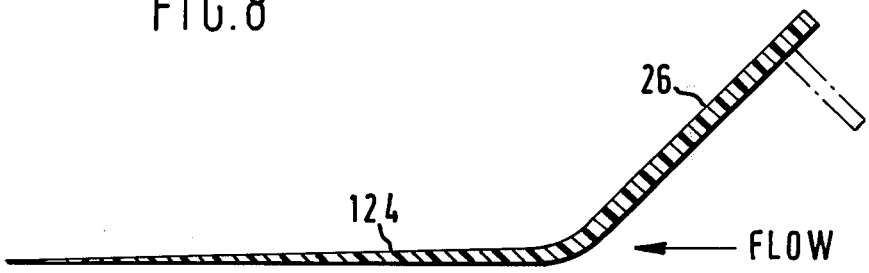
FIG. 9 is a longitudinal sectional view, similar to FIG. 7, of the control element of FIG. 4.
Figure 10:
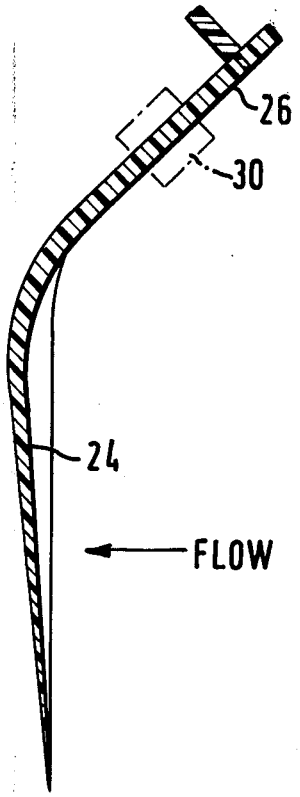
FIG. 10 is a longitudinal sectional view of the control element of FIG. 7 in a brake or maximum drag position.
Figure 11:
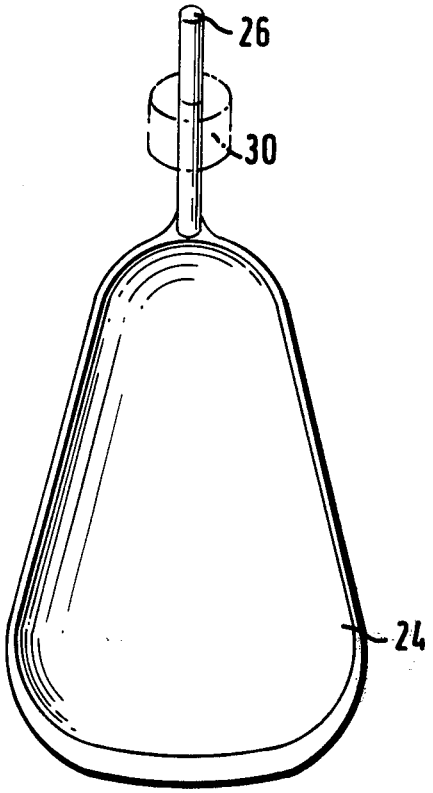
FIG. 11 is a front elevational view of the control element of FIG. 10.

Thus, the ultimate design of the symmetrical control element of the present invention may be widely varied. For example, while the control element illustrated in FIGS. 6 and 11 shows the fluid reaction fin to have a web-like shape with a tapered width, this may be modified to be circular, rectangular, or any other suitable shape to suit the ultimate application. Similarly, the fin, regardless of its shape, may be planar, as illustrated in FIG. 9; curved, as illustrated in FIGS. 7 and 8; or provided with a complex combination of flat, upwardly curved, and downwardly curved portions. The fin may also be formed with an upstanding longitudinal rib which operates in the manner of a conventional rudder.

Figure 12:
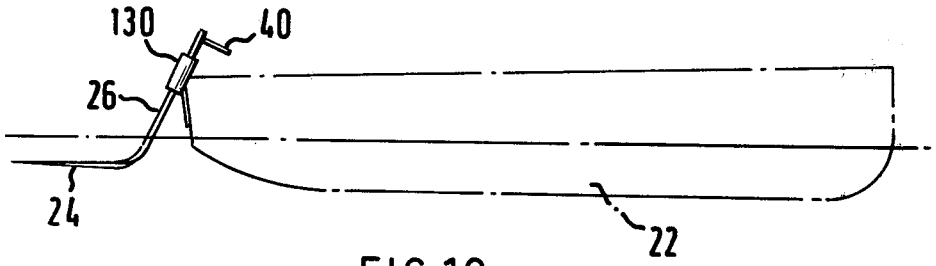
FIG. 12 is a side elevational view of a watercraft having a fluid reaction or control element attached to the transom thereof in accordance with the present invention.

In FIG. 12, shaft 26 is provided with a suitable handle or operator 40 and supports a fin 24 as shown in detail in FIG. 7. Shaft 26 is mounted in a bearing 130 which is permanently or detachably secured to the transom of vessel 22. As can be appreciated from a comparison of FIGS. 1 and 12, the operation of both embodiments of the control element is identical with the exception that the structure of FIG. 12 may be more easily added to existing or conventional vessels.

It should be understood that the control elements shown in FIGS. 1 and 12 are capable not only of low head loss or drag when in the neutral position, but also of self-retraction in the event an obstruction is engaged by the fin. This is particularly evident in FIG. 1 where the fin 24, in the neutral position (position A) is nested along the underside of the hull of vessel 22. If the fin was partially rotated away from neutral so as to steer the vessel, and it was struck by an object, it would automatically retract back to its nested neutral position thereby minimizing the risk of damage.

Figure 13:
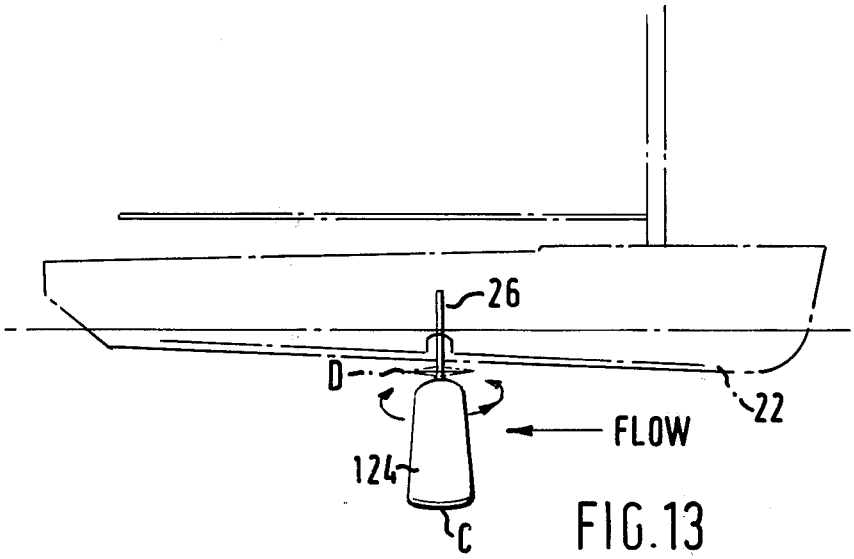
FIG. 13 is a side elevational view of a sailboat having a fluid reaction element mounted as a retractable keel in accordance with the present invention.
Figure 14:
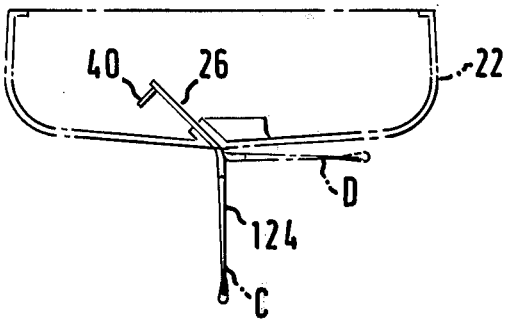
FIG. 14 is an end view of the sailboat of FIG. 13.

Turning to FIGS. 13 and 14, the control element of the present invention can be used as a retractable or adjustable keel (centerboard) for a sailboat or other vessel. Heretofore, centerboards for sailboats have generally been composed of a flat plate capable of retraction upwardly into the vessel. Use of the control element of the present invention eliminates the mechanical housing and support members of the prior art and frees the interior of the boat from clutter.

As shown in FIGS. 13 and 14, shaft 26 may be disposed in a vertical plane normal to the direction of travel of the vessel 22 at an angle such that a preferably flat fin 124 is rotatable between a vertical position C and a horizontal position D parallel to the direction of travel. Thus, the fin 24 always remains within the water, precluding the need for retraction and the associated apparatus, as well as lost space required by prior art devices. The only portion of the apparatus which projects within the craft is the shaft 26 and its operator 40 attached for rotation thereof. Thus, all of the benefits derivable from prior art centerboards are achievable by use of the present control element, while, concomitantly, all of the deficiencies are overcome.

Problems entirely analogous to those of centerboards in small sailing craft are presented by yaw stabilizers typically employed in large ships, notably in large passenger ships for ocean sailing. In rough seas, it is obviously desirable to minimize any discomfort to passengers on these ships and, for this purpose, relatively large yaw stabilizers are often provided which are caused to project from the ship hull to reduce annoying rocking motion. These large, cumbersome stabilizers are retracted within the hull in a manner not significantly different from that noted with respect to centerboards, except that large, hydraulic assemblies are generally required.

Figure 15:
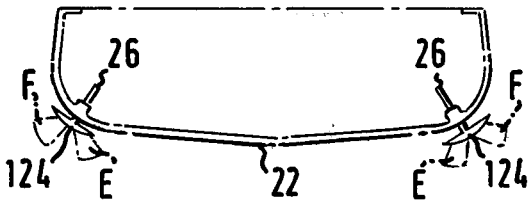
FIG. 15 is an end view of a watercraft having a pair of fluid reaction elements used as yaw stabilizers in accordance with the present invention.
Figure 16:
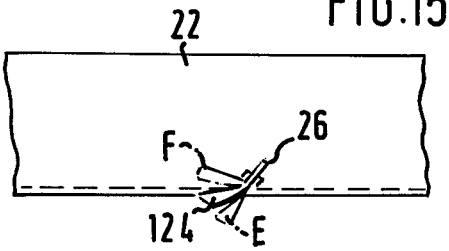
FIG. 16 is a side elevational view of the watercraft of FIG. 15.

FIGS. 15 and 16 illustrate the use of two control elements according to the present invention as yaw stabilizers for a large ship. The stabilizers are shown in operative and inoperative positions E and F, respectively, and except for size and strength, are mounted in the same orientation as described above with respect to FIGS. 13 and 14. Should it be desirable, the yaw stabilizers may be formed with negative curvature, as described above, and may also be shaped for cooperation with the ship's hull to promote streamlined hydrodynamics when retracted to position F.

As with the case where the present control elements are employed as centerboards, replacement of conventional stabilizers with those of the present invention provides results superior to those of conventional design. Additionally, tremendous savings, both in terms of lost space within the ship hull and elimination of costly machinery, are realized.

From the foregoing, it can be appreciated that the present invention provides a novel fluid reaction or control element which advantageously can be used as a rudder, keel or stabilizing member in connection with a vessel designed to be borne upon or within a fluid medium. The present control element reduces to a minimum the head loss or drag experienced when the element is not performing a control function, i.e., when it is in a neutral position. It also provides the unique ability to act as a brake or maximum drag member and to automatically retract under flow forces or when hitting an obstruction. It is also noted that the control element according to the present invention can be designed for use as an automatic steering device by using the control element as a wind sensitive assembly appropriately linked to drive a rudder. The element can also be constructed with the shaft attached to the toe of the fin in which case the fin will exert a more positive moment for the same increment of rotation.

It can be appreciated that the control element of the present invention is effective in accomplishing a method of steering or stabilizing a vessel by positioning a fluid reaction fin in the fluid medium and rotating the fin about an axis so that the fin traverses an arcuate path defining a right conical section.

Inasmuch as the present invention is subject to many variations, modifications and changes in detail, it is intended that all matter contained in the foregoing description or shown in the accompanying drawings shall be interpreted as illustrative and not in a limiting sense.

What is claimed is:

1. A minimum drag fluid element for a vessel carried upon or within a fluid medium, comprising:

a rotatable shaft having an axis of rotation defining a vertical plane together with a central longitudinal axis of the vessel;

a rigid fluid reaction fin having a major steering surface and a minor edge portion, said major steering surface of said fin being fixedly attached to said shaft for extension into the fluid medium, said shaft and said fin extending in opposite directions from a common intersection and forming an angle other than a right angle therebetween; and means connected to the vessel for supporting said shaft so that, in a neutral position, said major steering surface of said fin is positioned adjacent and parallel the underside of the vessel in the fluid medium substantially parallel to a horizontal plane in which the central longitudinal axis of the vessel is lying, whereby movement of said fin in either direction from said neutral position causes steering of the vessel in either direction;

the plane defined by the axis of rotation of said shaft and a central longitudinal axis of said fin being generally normal to said major steering surface of said fin whereby rotation of said shaft moves said fin through a path describing a right conical section.

2. A fluid reaction element as claimed in claim 1, in which the angle between said major steering surface of said fin and said shaft is obtuse.

3. A fluid reaction element as claimed in claim 2, in which the vertical plane containing the axis of the shaft bisects the fin.

4. A fluid reaction element as claimed in claim 1, in which the vertical plane containing the axis of the shaft bisects the fin.

5. The fluid reaction element as claimed in claims 1, 2, 3 or 4, wherein said fin is concavo-convex.

6. The fluid reaction element as claimed in claim 5, wherein the concave side of said fin faces the arc defined by said fin and said shaft.

7. The fluid reaction element as claimed in claim 5, wherein the convex side of said fin faces the arc defined by said fin and said shaft.

8. The fluid reaction element as claimed in claims 1, 2, 3 or 4, wherein said fin is planar.

9. The fluid reaction element as claimed in claims 1, 2, 3 or 4, wherein the width of said major steering surface of said fin tapers toward said common intersection with said shaft.

10. The fluid reaction element as claimed in claim 1, wherein said support means supports said shaft with the axis of rotation of the shaft disposed at an acute angle with respect to the central longitudinal axis of the vessel whereby said fin acts as a rudder for the vessel.

11. A vessel having a fluid reaction element as claimed in claim 10, said support means being attached to the hull of said vessel such that when said major steering surface of said fin is positioned parallel to and adjacent the underside of the vessel in said neutral position, a minimum head loss is presented to the fluid medium.

12. The fluid reaction element as claimed in claim 10, wherein said acute angle of said shaft is equal to 180 degrees minus the angle defined by said shaft and said major steering surface of said fin, whereby said fin is rotatable from said neutral position to positions inclined both horizontally and vertically with respect to the central longitudinal axis of the vessel.

13. The fluid reaction element as recited in claim 12, wherein said acute angle is 45 degrees and said angle defined by said shaft and said major steering surface of said fin is 135 degrees; and wherein said fin is rotatable 180 degrees about the axis of said shaft from said neutral position in which said major steering surface of said fin lies generally in a plane normal to the central longitudinal axis of the vessel.

14. A method of steering a vessel carried upon or within a fluid medium, comprising the steps of:

positioning a rigid fluid reaction fin defined by a major steering surface and a minor edge portion in the fluid medium in a neutral position so that said major steering surface is adjacent and parallel the underside of the vessel and substantially parallel to a horizontal plane in which a central longitudinal axis of the vessel is lying; and rotating said fin in either direction from said neutral position through a path describing a right conical section, the axis of rotation of which lies in a plane generally perpendicular to said major steering surface of said fin and is disposed to an acute angle with respect to the central longitudinal axis of the vessel, whereby the vessel is steered in either direction.

15. The method of claim 14, further including the step of rotating said fin 180 degrees through said path from said neutral position to a brake position at which the effective surface area of the fin presented to the fluid medium is greatest.

* * * * *